United States Patent [19]

Ichitsubo

[11] Patent Number: 4,981,447

[45] Date of Patent: Jan. 1, 1991

[54] ELECTRICAL CONNECTOR

[75] Inventor: Norio Ichitsubo, Yao, Japan

[73] Assignee: Hosiden Electronics Co., Ltd., Osaka, Japan

[21] Appl. No.: 476,579

[22] Filed: Feb. 7, 1990

[30] Foreign Application Priority Data

Feb. 28, 1989 [JP] Japan ..... 1-23659[U]

[51] Int. Cl.[5] ..... H01R 13/648

[52] U.S. Cl. ..... 439/607

[58] Field of Search ..... 439/607, 610, 609, 676, 439/608, 705, 703, 901, 904, 906

[56] References Cited

U.S. PATENT DOCUMENTS

| | | | |
|---|---|---|---|
| 4,337,989 | 7/1982 | Asick et al. | 439/609 |
| 4,653,825 | 3/1987 | Olsson | 439/607 |
| 4,678,121 | 7/1987 | Douty et al. | 439/610 |
| 4,787,860 | 11/1988 | Bender | 439/607 |
| 4,891,022 | 1/1990 | Chandler et al. | 439/610 |

*Primary Examiner*—Joseph H. McGlynn
*Assistant Examiner*—Hien D. Vu
*Attorney, Agent, or Firm*—Jones, Tullar & Cooper

[57] ABSTRACT

The present invention discloses an electrical connector having a first frame and a second frame each having a U-shape portion. The first and second frames are provided at the end edges of the leg portions of the U-shape portions thereof with inwardly turned engagement portions. These engagement portions of the first and second frames of the first and second frames are inserted, as brought face to face with each other, into engagement grooves formed in left- and right-hand lateral sides of a contact piece supporting member, so that the first and second frames are mounted on the contact piece supporting member. That is, the first and second frames surround the contact piece supporting member with no portions of the frames overlapping each other. A cap which overlaps portions of the frames may be slidably put and mounted on a signal cable.

14 Claims, 3 Drawing Sheets

ELECTRICAL CONNECTOR

BACKGROUND OF THE INVENTION

1. Field of the Invention

The present invention relates to an electrical connector which is adapted to be used in, for example, a computer and for which an anti-noise measure is being taken with the use of shielding frame means.

2. Description of the Invention

As a connector for which an anti-noise measure is being taken, there is known a connector of the type in which metallic frames surround the entire circumference of a contact piece supporting member which houses contact pieces. As an example of such a connector, there is known a connector disclosed by U.S. Pat. No. 4337989. In this connector, two frames each having a U-shape section cover the contact piece supporting member from the above and under thereof, and a plurality of projection pieces serving as leg portions of one U-shape frame are fitted in leg portions of the other frame, so that both frames are engaged with each other.

According to the conventional connector above-mentioned, the contact piece supporting member which houses the contact pieces is perfectly surrounded, at the entire circumference thereof, by the two frames, thus producing effective shielding results.

There is also known a connector in which there is formed, by insert-molding, a cap serving as an outer shell of a connector having a contact piece supporting member surrounded by frames. Such a connector produces the designing results that the cap is more pleasing in appearance.

In each of the conventional connectors above-mentioned, the two frames are connected to each other. To enhance the frame connecting strength, it is required that the projecting pieces of one frame overlap the leg portions of the other frame in a entire height direction thereof. This makes it difficult to make a connector having thin walls. Further, the lateral sides of the frames are doubled at the overlapping portions of the projecting pieces and the leg portions. Accordingly, the shield layer is made thick at such portions. Thus, the conventional connectors above-mentioned are hardly made in a very small size or very thin.

Further, the connector having the insert-molded cap presents the problem that the manufacturing cost is increased.

SUMMARY OF THE INVENTION

In view of the foregoing, the present invention is proposed with the object of providing an electrical connector of the type having two frames surrounding a contact piece supporting member as done in the conventional electrical connector, which is economical and excellent in strength and which readily achieves the demand for a very small and thin connector, yet having a shielding effect equivalent or superior to that of the conventional electrical connector.

It is another object of the present invention to provide an electrical connector having a cap serving as an outer shell portion which is readily formed without the use of troublesome insert-molding.

It is a further object of the present invention to provide an electrical connector in which first and second frames come in contact with each other more securely.

To achieve the objects above-mentioned, the electrical connector in accordance with an embodiment of the present invention comprises:

a contact piece supporting member provided at both lateral sides thereof with longitudinally extending engagement grooves;

a first metallic frame having a U-shape section and provided at the end edges of leg portions thereof with inwardly turned engagement portions which are inserted into he engagement grooves above-mentioned;

a second metallic frame having (i) a U-shape portion having a U-shape section and provided at the end edges of leg portions thereof with inwardly turned engagement portions which are inserted into the engagement grooves above-mentioned, and (ii) a casing portion extending from the rear end of the U-shape portion, the rear end opening of the casing portion being closed by turning a flat-plate portion which is extended from the casing portion; and contact pieces housed in and supported by the contact piece supporting member;

the engagement portions of the first and second frames being inserted, as brought face to face with each other, into the engagement grooves above-mentioned, the first and second frames surrounding the entire circumference of the contact piece supporting member.

According to the electrical connector of the present invention having the arrangement above-mentioned, the first and second frames perfectly surround the circumference and the back side of the contact piece supporting member which houses the contact pieces, thus producing shielding results equivalent or superior to those of the conventional electrical connector.

The engagement portions of the first and second frames serve as reinforcing ribs, and the frames are inserted into the engagement grooves of the contact piece supporting member with these engagement portions brought face to face with each other. This enhances not only the frame connecting strength, but also the entire strength of the resultant connector. In spite of the foregoing, the electrical connector of the present invention eliminates the need that the frames partly fittingly overlap each other. Thus, as compared with the conventional electrical connector, the present invention readily achieves the demand for a very small or thin connector.

According to the present invention, the first frame may be provided at the rear end thereof with a holding piece which projects inside of the casing portion of the second frame to hold the shield layer of a signal cable. In this arrangement, the shield layer of the signal cable may be connected, in the inside of the casing portion, to the second frame, i.e., a shielding frame.

The electrical connector in accordance with another embodiment of the present invention, further comprises a cap slidably put on a signal cable connected to the contact pieces, and the cap is fitted to the first and second frames.

By forming the cap in the manner above-mentioned, the cap is not required to be formed by insert-molding, reducing the manufacturing cost.

According to the present invention, the first frame having a U-shape section may be provided at the rear ends of the leg portions thereof with resilient projecting pieces, these projecting pieces being rearwardly extended and provided on the outer surfaces thereof with small projections, and these small projections may be contact-pressed to the inner walls of the casing portion of the second frame. By such an arrangement, the first and second frames may come in contact with each other more securely.

Projection holes may be respectively formed in the first and second frames, and projections formed on the contact piece supporting member may be respectively engaged with these engagement holes. By such an arrangement, the contact piece supporting member may be securely fixed at an accurate position.

Other features of the present invention will be apparent from the following description of preferred embodiments thereof.

DETAILED DESCRIPTION OF THE PREFERRED EMBODIMENTS

Figure 1:
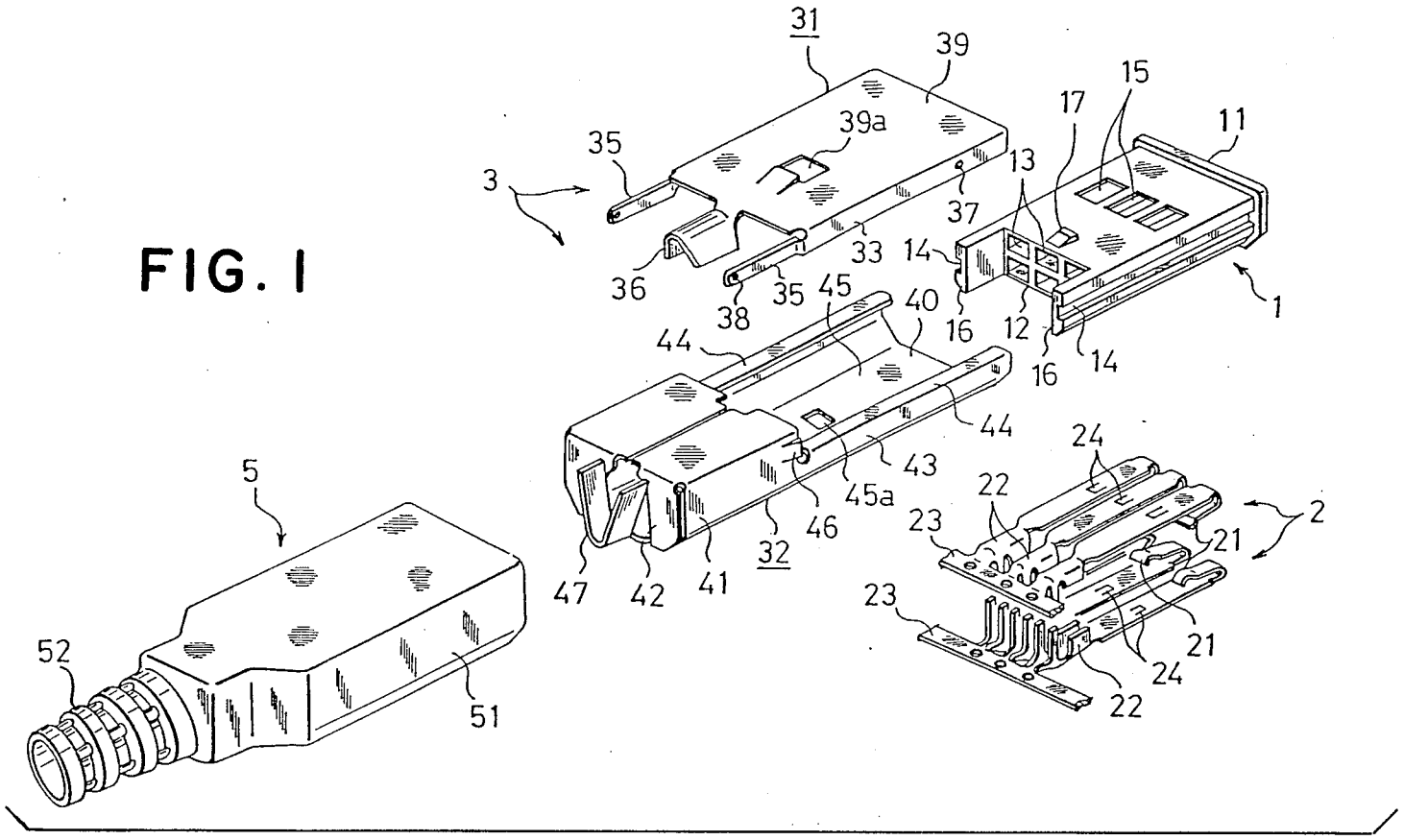
FIG. 1 is an exploded perspective view of an electrical connector in accordance with the present invention.

As shown in FIG. 1, the electrical connector in accordance with the present invention comprises a contact piece supporting member 1, contact pieces 2, a shielding frame 3 and a cap 5.

The contact piece supporting member 1 is provided at the front end thereof with a flange 11 and in the inside thereof with a plurality of contact piece inserting holes 13 formed by a lattice-like rib 12. The contact piece supporting member 1 is provided at the left- and right-hand lateral sides thereof with longitudinally extending engagement grooves 14, respectively. The contact piece supporting member 1 is also provided on the top and bottom surfaces thereof with engagement holes 15 respectively corresponding to the contact piece inserting holes 13. The contact piece supporting member 1 is also provided at both lateral sides of the rear end thereof with rearwardly extending projections 16. The contact piece supporting member 1 is further provided on the top and bottom surfaces thereof with projections 17 (only the projection 17 on the top surface is shown in FIG. 1).

Figure 3:
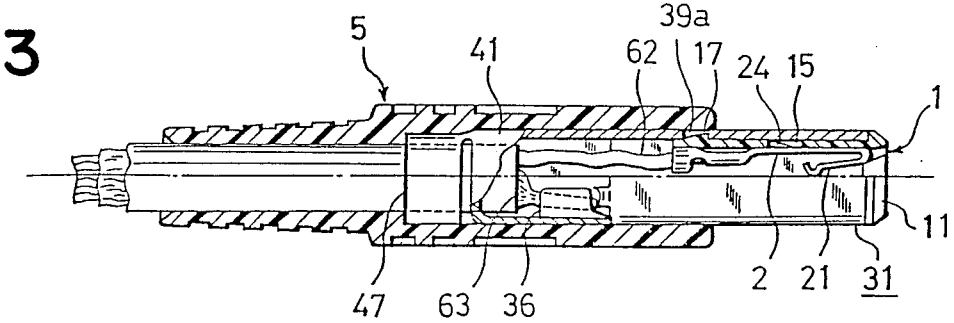
FIG. 3 is a side view, with portions broken away, of the electrical connector in FIG. 1.

Each of contact pieces 2 is made of a metallic piece which is folded back at the tip thereof which serves as a contact 21. The contact pieces 2 are provided at the rear ends thereof with fork-like holding pieces 22 and at the intermediate portions thereof with cut-raised engagement pieces 24. Before assembling the contact pieces 2 with the contact piece supporting member 1, the contact pieces 2 are being joined together with the use of tie bars 23, as shown in FIG. 1. These tie bars 23 are adapted to be cut at the same time when the holding pieces 22 are calked with electric wires 62, to be discussed later. The contact pieces 2 are respectively inserted into the contact piece inserting holes 13 of the contact piece supporting member 1, such that the cut-raised engagement pieces 24 are engaged with the edges of the engagement holes 15 in the contact piece supporting member 1, as shown in FIG. 3. This prevents the contact pieces 2 from coming off from the contact piece supporting member 1.

Figure 4:
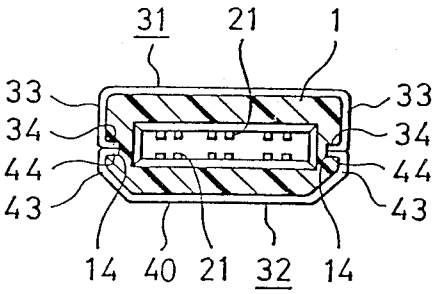
FIG. 4 is a vertical section view in front elevation of main portions of the electrical connector in FIG. 1.

A shielding frame 3 comprises a first frame 31 and a second frame 32. As shown in FIG. 4, the first frame 31 has a U-shape section and is provided at the end edges of left- and right-hand leg portions 33 thereof with engagement portions 34. As shown in FIG. 1, the leg portions 33 are provided at the rear ends thereof with resilient projecting pieces 35 which are rearwardly extended.

The first frame 31 is provided at the center portion between the projecting pieces 35 with a forklike holding piece 36 integral with the first frame 31.

The leg portions 33 are provided on the outer surfaces thereof with small projections 37, while the projecting pieces 35 are provided on the outer surfaces thereof with small projections 38. The first frame 31 is further provided in a top plate portion 39 thereof with an engagement hole **39*a***.

The second frame 32 comprises a U-shape portion 40 and a casing portion 41 extending at the rear end of the U-shape portion 40. The second frame 32 is further provided at the rear end of the casing portion 41 with a rearwardly extending flat-plate portion 42 integral with the casing portion 41. The flat-plate portion 42 is adapted to be downwardly turned at a right angle to the top surface of the casing portion 41, thereby to close the rear end opening thereof. As shown in FIG. 4, the U-shape portion 40 has a U-shape section and is provided at the end edges of leg portions 43 thereof with engagement portions 44. The U-shape portion 40 is provided in a bottom plate portion 45 thereof with an engagement hole **45*a*. The casing portion 41 is provided at both lateral sides of the front end thereof with outwardly spreading cut-raised engagement pieces 46. The casing portion 41 is integrally provided at the rear end thereof with a forklike holding piece 47**.

Figure 2:
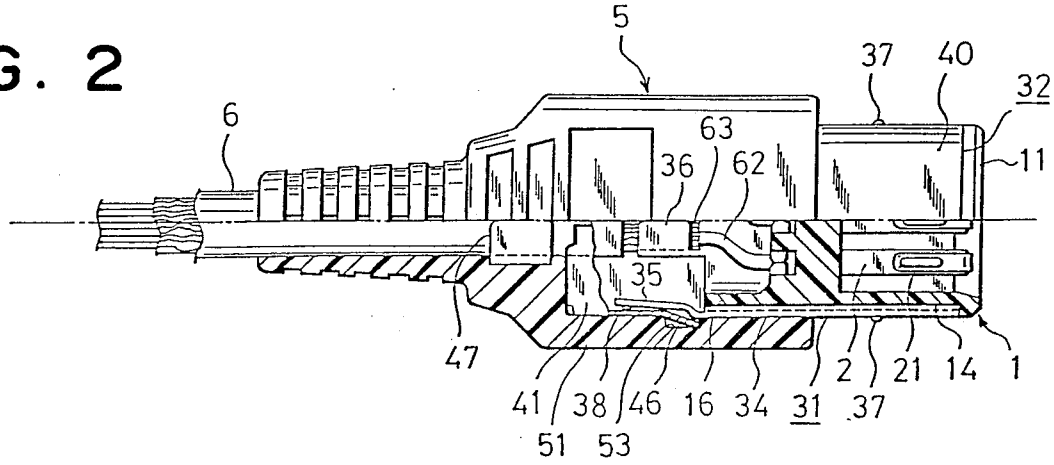
FIG. 2 is a plan view, with portions broken away, of the electrical connector in FIG. 1.

The engagement portions 34, 44 of the first and second frames 31, 32 are inserted, as brought face to face with each other, into the engagement grooves 14 of the contact piece supporting member 1. The projections 17 of the contact piece supporting member 1 are respectively engaged with the edges of the engagement hole **39*a* in the first frame 31 and the engagement hole 45*a* of the second frame 32. This prevents the contact piece supporting member 1 from coming out from the frame 3. The projecting pieces 35 of the first frame 31 are inserted into the casing portion 41 with the engagement pieces 46 of the second frame 32 serving as guides. As shown in FIG. 2, the small projections 38 of the projecting pieces 35 are locally strongly contact-pressed to the inner walls of the casing portion 41 by the spring loads inherent in the projecting pieces 35. Accordingly, the first frame 31 securely comes in contact with the second frame 32. The holding piece 36 of the first frame 31 projects inside of the casing portion 41 of the second frame 32**.

The cap 5 has a hollow shell portion 51 and a resilient portion 52 integral with the shell portion 51. The cap 5 is formed as a molded article having flex and resiliency. The cap 5 is slidably put on a signal cable 6 shown in FIGS. 2 and 3, before the signal cable 6 is connected to the contact pieces 2. The contact pieces 2 assembled with the contact piece supporting member 1 in the manner above-mentioned are connected, by contact-bonding or the like, to electric wires 62 corresponding to the contact pieces 2. When the cap 5 is slided after the first frame 31 and the second frame 32 have been assembled with the contact piece supporting member 1 in the manner above-mentioned, the cap 5 is fitted to the first frame 31 and the second frame 32.

The holding pieces 22 of the contact pieces 2 hold the electric wires 62, and the holding piece 36 of the first frame 31 holds the shield layer (formed by a metallic net or the like) of the signal cable 6. Further, the holding piece 47 of the second frame 32 holds the signal cable 6 in its entirety. As shown in FIG. 2, the engagement pieces 46 of the second frame 32 are engaged with concave portions 53 formed in the inner surfaces of the shell portion 51. This prevents the cap 5 from coming out from the frame 3.

In the electrical connector assembled in the manner above-mentioned, the first frame 31 and the U-shape portion 40 of the second frame 32 surround the entire circumference of the contact piece supporting member 1 which houses the contact pieces 2. The casing portion 41 and the flat-plate portion 42 of the second frame 32 surround the portion of the holding piece 36 of the first frame 31 connected to the shield layer 63 of the signal cable 6, and also surround the electric wires 62. Thus, the frame 3 produces very effective shielding results for the entire exposed portions of the electric wires 62 and the contact piece supporting member 1. Further, the engagement portions 34, 44 of the first frame 31 and the second frame 32 serve as reinforcing ribs. Since the engagement portions 34, 44 are inserted, as brought face to face, into the engagement grooves 14 of the contact piece supporting member 1, the first frame 31 and the second frame 32 are securely bonded with each other. This enhances the strength of the resultant electrical connector in its entirety.

Figure 5:
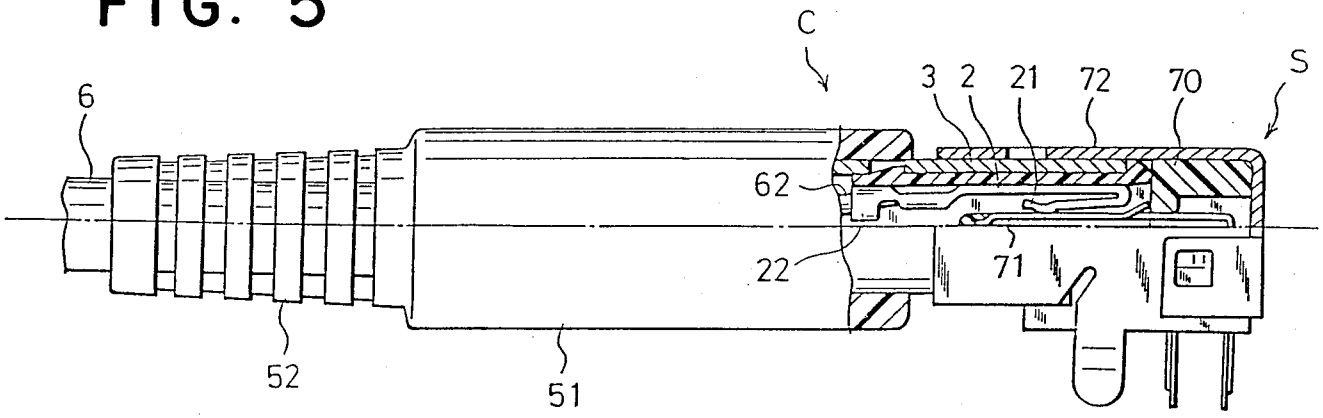
FIG. 5 is a side view, with portions broken away, of the electrical connector in FIG. 1 connected to a socket.

FIG. 5 shows the electrical connector C abovementioned, as connected to a counter connector, i.e., socket S. In the socket S, a single shielding frame 72 perfectly surrounds the circumference and the back side of a contact piece supporting member 70 which houses contact pieces 71. When the electrical connector C is inserted into the frame 72 of the socket S, the frames 3 and 72 come in contact with each other substantially at the entire circumferences thereof. Further, the projections 37 (See FIG. 1) of the first frame 31 are locally strongly contact-pressed to the outer surfaces of the frame 72 of the socket S. Accordingly, the frames 3 and 72 perfectly surround the portion of the electrical connector C connected to the socket S, thus producing effective shielding results.

What is claimed is:

1. An electrical connector comprising:

a contact piece supporting member provided at both lateral sides thereof with longitudinally extending engagement grooves;

a first metallic frame having a U-shape section and provided at the end edges of leg portions thereof with inwardly turned engagement portions which are inserted into said engagement grooves;

a second metallic frame having (i) a U-shape portion having a U-shape section and provided at the end edges of leg portions thereof with inwardly turned engagement portions which are inserted into said engagement grooves, and (ii) a casing portion extending from the rear end of said U-shape portion, the rear end opening of said casing portion being closed by turning a flat-plate portion which is extended from said casing portion; and contact pieces housed in and supported by said contact piece supporting member;

said engagement portions of said first and second frames being inserted, as brought face to face with each other, into said engagement grooves, said first frame and said second frame surrounding the entire circumference of said contact piece supporting member.

2. An electrical connector as set forth in claim 1, further comprising a cap slidably put on a signal cable adapted to be connected to the contact pieces, said cap being fitted to the first frame and the second frame.

3. An electrical connector as set forth in claim 1, wherein projections respectively formed on the contact piece supporting member are respectively engaged with engagement holes respectively formed in the first frame and the second frame.

4. An electrical connector as set forth in claim 1, wherein the contact piece supporting member has contact piece inserting holes formed by a lattice-like rib, and engagement pieces formed on the contact pieces are engaged with engagement holes formed in said contact piece supporting member, thereby to prevent said contact pieces inserted in said contact piece inserting holes from coming off from said contact piece supporting member.

5. An electrical connector as set forth in claim 1, wherein the contact piece supporting member is provided at the front end thereof with a flange with which the front ends of the first and second frames come in contact.

6. An electrical connector as set forth in claim 1, wherein the first frame is provided at the rear end thereof with a holding piece which extends from said rear end, said holding piece projecting inside of the casing portion of the second frame for holding the shield layer of a signal cable.

7. An electrical connector as set forth in claim 6, further comprising a cap slidably put on a signal cable adapted to be connected to the contact pieces, said cap being fitted to the first frame and the second frame.

8. An electrical connector as set forth in claim 7, wherein the first frame having a U-shape section is provided at the rear ends of the leg portions thereof with resilient projecting pieces, said projecting pieces being rearwardly extended and provided on the outer surfaces thereof with small projections, said small projections being contact-pressed to the inner walls of the casing portion of the second frame.

9. An electrical connector as set forth in claim 8, wherein projections respectively formed on the contact piece supporting member are respectively engaged with engagement holes respectively formed in the first frame and the second frame.

10. An electrical connector as set forth in claim 9, wherein the contact piece supporting member has contact piece inserting holes formed by a lattice-like rib, and engagement pieces formed on the contact pieces are engaged with engagement holes formed in said contact piece supporting member, thereby to prevent said contact pieces inserted in said contact piece inserting holes from coming off from said contact piece supporting member.

11. An electrical connector as set forth in claim 10, wherein the contact piece supporting member is provided at the front end thereof with a flange with which the front ends of the first and second frames come in contact.

12. An electrical connector as set forth in claim 11, wherein the casing portion of the second frame is provided at both lateral sides of the front end thereof with outwardly spreading cut-raised engagement pieces for guiding projecting pieces of the first frame, and said cut-raised engagement pieces are engaged with concave portions formed in the inner surfaces faces of the cap.

13. An electrical connector as set forth in claim 1, wherein the first frame having a U-shape section is provided at the rear ends of the leg portions thereof with resilient projecting pieces, said projecting pieces being rearwardly extended and provided on the outer surfaces thereof with small projections, said small projections being contact-pressed to the inner walls of the casing portion of the second frame.

14. An electrical connector as set forth in claim 13, wherein the casing portion of the second frame is provided at both lateral sides of the front end thereof with outwardly spreading cut-raised engagement pieces for guiding projecting pieces of the first frame, and said cut-raised engagement pieces are engaged with concave portions formed in the inner surfaces of a cap.

* * * * *